US005399410A

United States Patent [19]

Urase et al.

[11] Patent Number: 5,399,410

[45] Date of Patent: Mar. 21, 1995

[54] SHEET FOR EMBROIDERED PICTURE

[76] Inventors: Ichiro Urase, 458, Nishimachi, Aburanokoji-Nishiiru, Motosenganji-Dori, Kamigyo-ku, Kyoto-shi, Kyoto-fu, Japan; Hisae Nakayama, Noa Heights 802, 526-2, Karatsuya-cho, Shijohorikawa-Nishiiru, Shimogyo-ku, Kyoto-shi, Kyoto-fu, Japan

[21] Appl. No.: 96,221

[22] Filed: Jul. 26, 1993

[30] Foreign Application Priority Data

Jul. 28, 1992 [JP] Japan ..... 4-058637 U

[51] Int. Cl.[6] ..... D05C 1/00; D05C 17/00

[52] U.S. Cl. ..... 428/102; 428/138; 428/906.6; 112/439; 112/266.1; 434/95

[58] Field of Search ..... 428/102, 131, 138, 906.6; 112/439, 266.1; 434/95

[56] References Cited

U.S. PATENT DOCUMENTS

| | | | |
|---|---|---|---|
| 1,051,316 | 1/1913 | Druckerman | 428/906.6 |
| 1,517,867 | 2/1924 | Sexton | 428/906.6 |
| 4,640,529 | 3/1987 | Katz | 428/906.6 |

*Primary Examiner*—Alexander S. Thomas

[57] ABSTRACT

A sheet for embroidered picture includes a sheet-like base 1 made of paper such as synthetic paper or thick paper. Perforations 0.4–1.5 mm in inside hole diameter are formed in matrix form at least a part of the sheet-like base 1. From the sheet-like base 1, a sheet piece 4 in the desired shape can be cut off easily by trimming off along the perforations 2 with a pair of scissors or the like. The sheet piece 4 thus cut off in the desired shape may then be laminated on another sheet-like base 1, when an embroidery thread 3 is passed through the perforations 2 along the other sheet-like base 1 and the sheet piece 4, a three-dimensional embroidered picture is made. On the surface of the sheet-like base 1, a picture or pattern may be drawn, and an embroidered picture excelled in designability may be made when the picture or pattern is used as a background.

20 Claims, 3 Drawing Sheets

SHEET FOR EMBROIDERED PICTURE

BACKGROUND OF THE INVENTION

1. Field of the Invention

The present invention relates to a sheet for embroidered picture and more particularly relates to a sheet for an embroidered picture wherein a picture or a pattern can be drawn by using an embroidery thread.

2. Description of the Prior Art

Hitherto, there has been known methods of drawing a picture on a surface of a fabric by embroidering with embroidery threads of various colors and of using such an embroidered picture as an interior decoration. Drawing such an embroidered picture, however, requires professional techniques, and it is difficult to draw a picture or pattern by embroidery for general people fond of craft, including children.

It is also general to make a cushion by embroidering on a surface of a plain fabric. Such a fabric, however, does not suit for making a three-dimensional embroidered picture.

Further, it is known to apply embroidery to a mesh sheet made of plastic. Since, however, such a mesh sheet is manufactured by heat-treating a plastic mesh, the inside diameter of holes is generally large, and there is a limit to the arrangement density for holes. Also with such a mesh sheet, there are problems such as irregularity of the size of holes for passing an embroidery thread, holes being blocked, and the shape of holes being not truly round. Moreover, such a mesh sheet is only good for doing embroidery on its surface and less suited for doing a three-dimensional embroidered picture.

SUMMARY OF THE INVENTION

Therefore, the principal object of the present invention is to provide a sheet for an embroidered picture wherein a three-dimensional embroidered picture can be made easily by embroidering.

The present invention was completed by using that a plurality of perforations are formed in a sheet-like base in precise matrix form by hole-making process and a picture or pattern can be drawn easily by passing an embroidery thread through the perforations.

A sheet for embroidered picture according to the present invention is a sheet for embroidered picture having a sheet-like base embroidered with an embroidery thread characterized in that perforations 0.4–1.5 mm in inside hole diameter are formed at least a part of the sheet-like base in matrix form.

It is preferable that the sheet-like base is made of paper such as synthetic paper or thick paper.

Also it is preferable to form a picture or pattern on a surface of the sheet-like base.

A three-dimensional embroidered picture can be made easily by cutting the sheet-like base into a sheet piece with a pair of scissors or the like and laminating the sheet piece on the sheet-like base with an embroidery thread.

When the sheet-like base is made of paper such as synthetic paper or thick paper, the sheet-like base can be cut easily with a pair of scissors or the like.

When the picture or pattern is formed on the surface of the sheet-like base, the picture or pattern can be utilized as a background for a picture or pattern drawn with an embroidery thread.

According to the present invention, a sheet for embroidered picture wherein a three-dimensional embroidered picture can be made easily by embroidering.

When the sheet-like base is made of paper such as synthetic paper or thick paper, the sheet-like base can be cut easily, therefore, a three-dimensional embroidered picture can be made more easily.

Further, when the picture or pattern can be formed on the surface of the sheet-like base, the picture or pattern can be utilized as the background for the picture or pattern drawn with the embroidery thread, thus making an embroidered picture excelled in designability.

The above and other objects, features, aspects and advantages of the present invention will become more apparent from the following detailed description of the embodiments with reference to the accompanying drawings.

DESCRIPTION OF THE PREFERRED EMBODIMENTS

Figure 1:
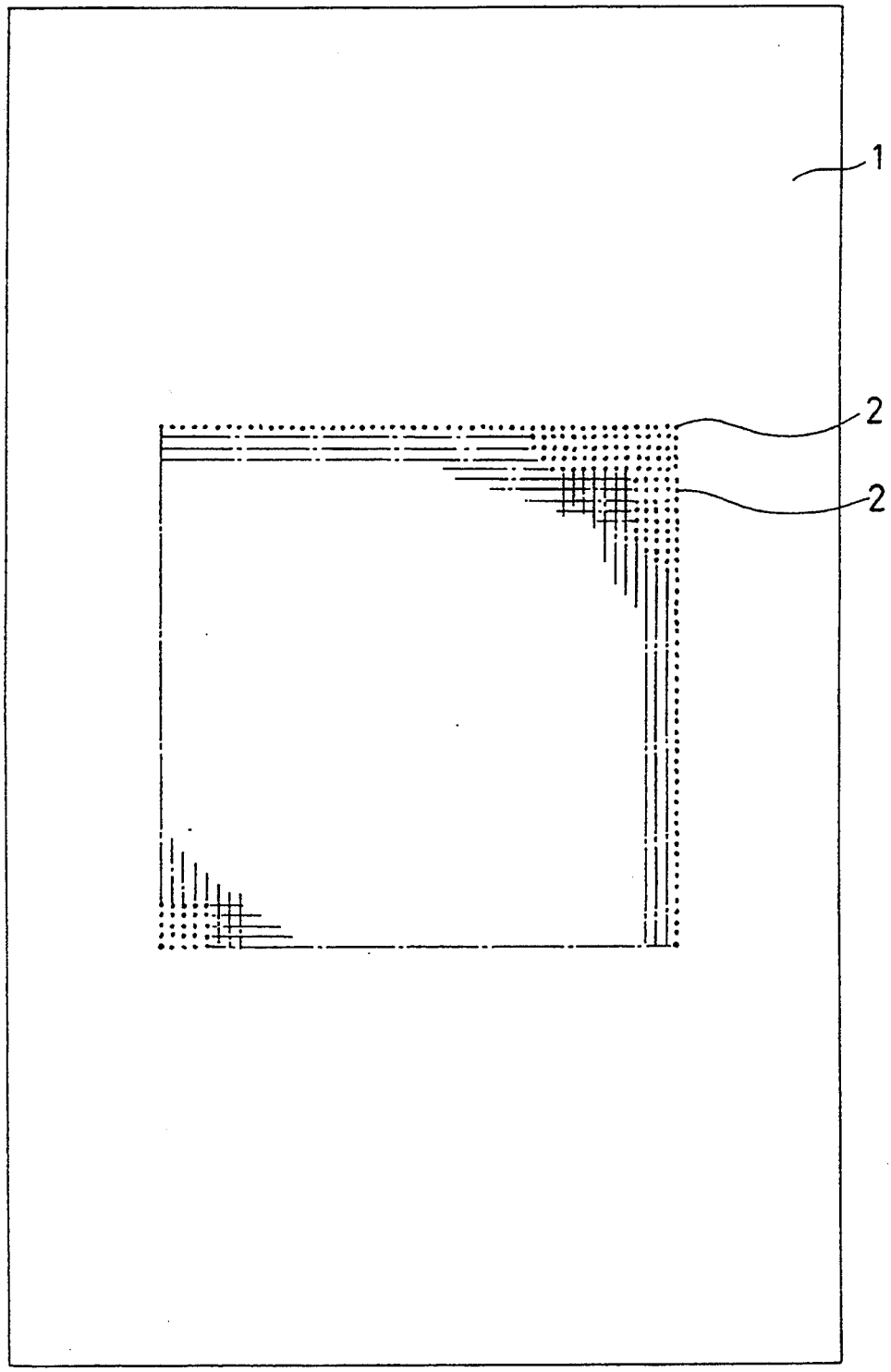
FIG. 1 is a plan view showing one embodiment of the present invention.

FIG. 1 is a plan view showing one embodiment of the present invention. The sheet for embroidered picture shown in FIG. 1 includes, for example, a sheet-like base 1 cut in rectangular form 12 cm×20 cm of a commercially available off-white synthetic paper about 0.4 mm thick.

In the central portion of the sheet-like base 1, as shown as black points in FIG. 1, there are perforations 2, for example, 0.8 mm in inside hole diameter in matrix form of 50×50 at a pitch of 1.5 mm. In FIG. 1, parts of the perforations are omitted.

In the present invention, the material of the sheet-like base 1 is not particularly limited and it is only required to be capable of making holes. This means that various sheet-like bases such as paper like thick paper other than the aforementioned synthetic paper, plastic, nonwoven fabric and metals may be used. For a sheet for embroidered picture suited for making a three-dimensional embroidered picture, however, it is preferable that the sheet-like base is made of paper such as synthetic paper or thick paper which can be cut easily with a pair of scissors, cutter or the like. As paper such as synthetic paper or thick paper, stiff in paper quality with no indication of fluffing in making holes is suited, if one too soft in paper quality is used, it may result in difficulty in making holes. When thick paper is used as the material of the sheet-like base 1, it is preferred to be a type difficult for inter-layer separation in the corners. Meanwhile, when synthetic paper is used as material of the sheet-like base 1, the sheet-like base 1 is difficult for inter-layer separation in corners, difficult to fold, bend and elongate and has another merit of forming perforations uniformly.

Further, in the present invention, the sheet-like base 1 is not limited to a rectangular form of 12 cm×20 cm and may be formed, for example, in a square of 15 cm×15 cm, a circle 30 cm in diameter or the like.

Furthermore, the thickness of the sheet for embroidered picture according to the present invention is not particularly limited if the perforations 2 may be formed in the sheet-like base 1 with a high precision, but if the sheet-like base 1 is made of synthetic paper, it is particularly preferred to be about 0.4 mm from the viewpoints of a stiff state of the base and a hole-making property of the perforations 2. When the sheet-like base 1 is made of thick paper, it is particularly preferred to be about 0.8 mm from the viewpoints of the stiff state of the base and the hole-making property of the perforations 2.

Also, in the sheet for embroidered picture according to the present invention, the color of the sheet-like base 1 is not limited to off-white but may be a single natural color or a combination of various colors.

Although the inside hole diameter of each perforation 2 is about 0.8 mm in the aforementioned embodiment, the inner diameter of each perforation 2 may be 0.4–1.5 mm in the present invention. This is because, if the inside hole diameter of the perforation 2 is less than 0.4 mm, embroidery is difficult due to passing difficulty for an ordinary needle and thread for embroidery, and hole-making process is difficult. Inversely, if the inner diameter of the perforation 2 is in excess of 1.5 mm, the perforation 2 is visible even after embroidery, this resulting in an inferior external view. In the sheet for embroidered picture according to the present invention, it is particularly preferred to have the inside hole diameter of each perforation 2 about 0.8 mm. This is because, if the inner diameter of the perforation 2 is about 0.8 mm, 2-ply or 3-ply embroidery thread is easy to pass through the perforation 2, various European embroideries are applicable through the perforation 2 such as cross stitch, satin stitch and so on, and even if the perforations 2 are overlapped, an embroidery thread is easy to pass through the perforations 2, and further it is easy to count the number of the perforations 2.

Further, although the perforations 2 are 50×50 holes in the above embodiment, but the number of the perforations 2 is not particularly limited in the present invention. Since the number of the perforations 2 is increased, a delicate picture or pattern can be made by using a fine thread. In the sheet for embroidered picture according to the present invention, particularly suited is a total number of 10,000–30,000 or so of the perforations 2.

Furthermore, the perforations 2 are in matrix form and formed in the central portion of the sheet-like base 1 in the sheet for embroidered picture as illustrated in FIG. 1, but in the present invention, the perforations 2 may be formed in matrix form over the entire surface of the sheet-like base 1 and is not required for the numbers of lengthwise and sidewise perforations 2, being equal as shown in FIG. 1.

Further, the pitch between the perforations 2 in the sheet for embroidered picture according to the present invention depends on the material of the sheet-like base 1 and the inside hole diameter of the perforation 2, and if the pitch is made too large, it is difficult in drawing a delicate picture or pattern with difficulty in obtaining a three-dimensional pyramid-like feeling, hence generally formed pitch for adjacent perforations 2 is about 1.3–2 mm, the most preferred being 1.5 mm. If the pitch between the adjacent perforations 2 is too small, it results in difficulty to view the perforations 2, difficulty in doing embroidery and also difficulty in counting the number of the perforations 2.

The sheet for embroidered picture according to the present invention is manufactured by making holes in the sheet-like base 1, and punching-through is generally adopted for forming the perforations 2 small in inside hole diameter in matrix form. As the method for forming the perforations 2 preferred is successively sending the sheet-like bases 1 to a punching die provided with cutters arranged in matrix form.

By using such punching procedure, the perforation 2 is formed of true-round holes in the sheet for embroidered picture according to the present invention. The pitch precision of the perforations is high compared with the conventional mesh-sheet, the arrangement density being also high.

Now a concrete example of a three-dimensional embroidered picture made by using the sheet for embroidered picture according to the present invention will be shown.

Figure 2:
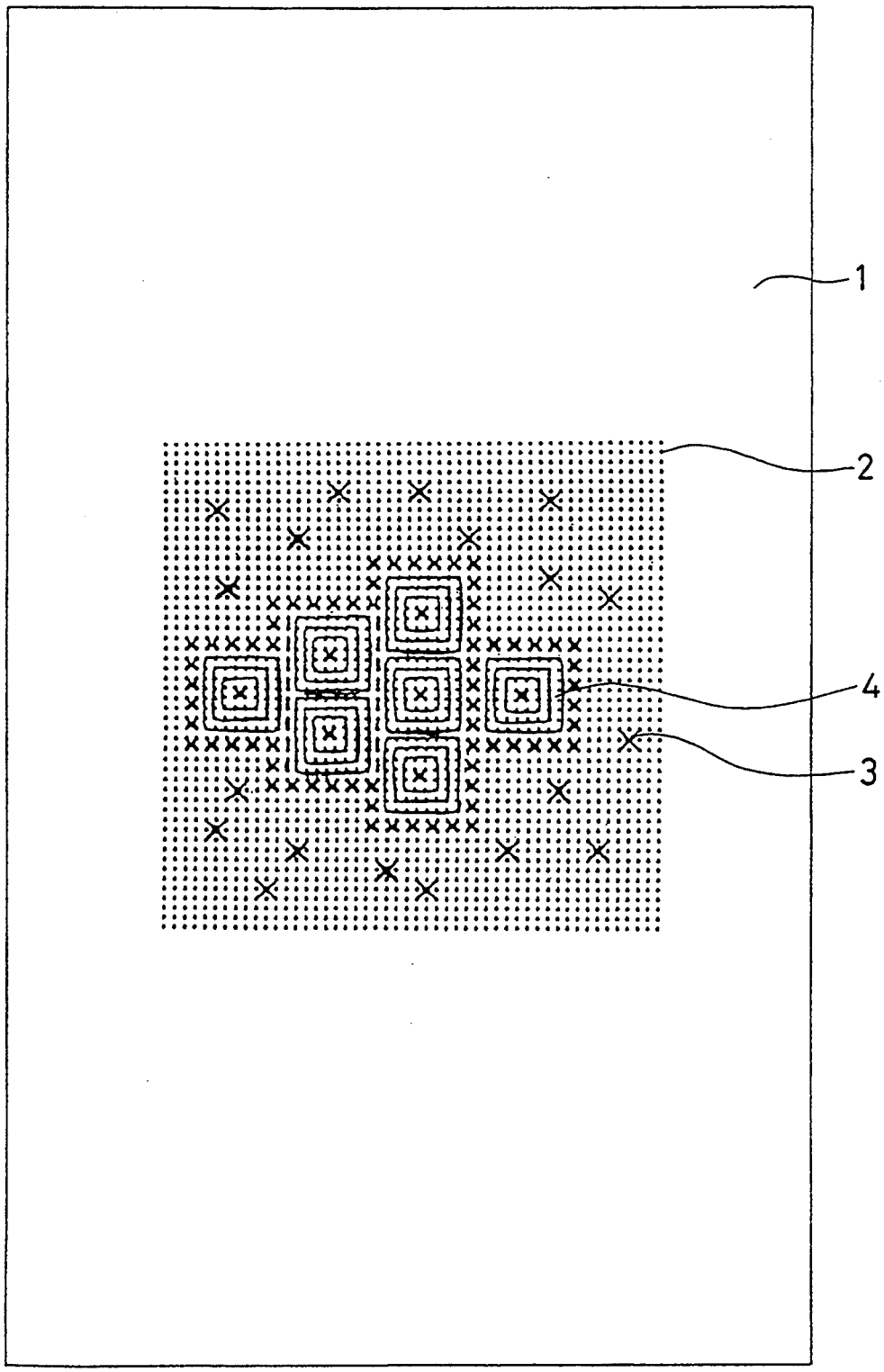
FIG. 2 is a plan view showing an example of embroidered picture made by using a sheet for embroidered picture shown in FIG. 1.

FIG. 2 is a plan view showing an example of embroidered picture made by using the sheet for embroidered picture shown in FIG. 1, and in the embroidered picture, a picture or pattern simulating the external view of a tree is represented by the embroidery thread 3. Moreover, in the embroidered picture, there is formed a three-dimensional part as shown in FIG. 3 as a partially enlarged picture.

Considering that for the sheet for embroidered picture according to the present invention a colorful and still more beautiful effect is attainable, it is preferred to use #25 thread best available in the world. As the embroidery thread it is preferred to use 2-ply thread or 3-ply thread. Because, with embroidery threads not less than 4-ply, it is difficult for beginners with the threads tending to twist or to be lifted and, moreover, the threads are too voluminous, this resulting in lack of delicacy of embroidered picture. With 1-ply embroidery thread, on the other hand, is too weak in coloristic effect in embroidered picture, the embroidery thread is apt to be broken, and the value of the embroidered picture as product is nearly halved. Furthermore, combined use of 2-ply and 3-ply embroidery threads, it is also possible to vary the strength and density of the color of embroidered picture.

The kind of the embroidery needle for the sheet for embroidered picture according to the present invention is to be determined with the kind of embroidery thread to be used, the size of the perforation of the sheet for embroidered picture and so on, and preferred is use of French embroidery needle #8. When the embroidery needle is too thick, the embroidery thread is easy to pass through its hole but it is difficult to pass the needle through the perforation of the embroidered picture. When, on the other hand, the embroidery needle is too thin, it is not only that the embroidery thread is difficult to pass through its hole, but it is difficult to embroider as the needle drop through the perforation of the sheet for embroidered picture.

Figure 3:
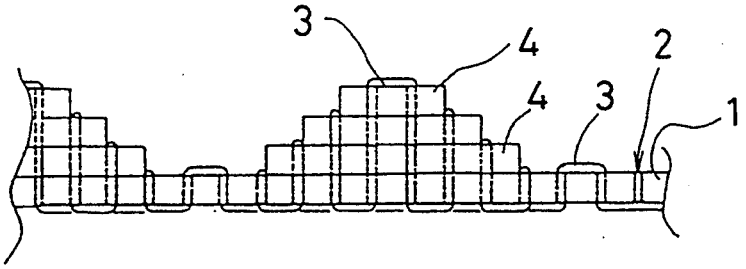
FIG. 3 is a partially enlarged view showing a three-dimensional portion of the embroidered picture shown in FIG. 2.

In order to make the embroidered picture of the structure shown in FIG. 2 and FIG. 3, two sheets for embroidered picture are prepared, for example.

In this case, the sheet for embroidered picture shown in FIG. 1 is prepared.

Further, commercially available natural colored thick paper 0.8 mm in thickness is, for example, cut in rectangular shape 12 cm×20 cm for formation of sheet-like base, then perforations of the same inside hole diameter as the perforations 2 of the sheet for embroidered picture as shown in FIG. 1 are formed all over the surface of this sheet-like base at the same pitch, and thus another sheet for embroidered picture is prepared. This another sheet for embroidered picture is to be cut off for use.

Then, this another sheet for embroidered picture is cut off into the sheet pieces 4 of the desired shape along the perforations. Thereafter, the cut-off sheet pieces 4 are laminated on the other sheet for embroidered picture. Further, the perforations 2 in the sheet for embroidered picture and the sheet pieces 4 are matched as shown in FIG. 3, and these are joined by passing the embroidery thread 3 through the perforations 2 and the embroidered picture shown in FIG. 2 is made by integration. The embroidered picture thus obtained is highly three-dimensional.

The number of the sheet pieces 4 laminated on the sheet for embroidered picture is not necessarily 3, but may be 1, 2, 4 or even more.

As the sheet-like base 1 for use in cut pieces it is preferred to have perforations 2 all over the sheet surface so that as many sheet pieces 4 can be taken. It is also preferred that the thickness of the laminated sheet-like base 1 is not less than about 0.8 mm. When the sheet-like base 1 is used in cut pieces, it is necessary to select the pitch of the perforations 2 to be about 1.5 mm. If the pitch is too large, it is difficult to cut the sheet piece in the desired shape by means of perforations 2.

By the way, in the present invention, as the sheet-like base 1 not to be cut in making a three-dimensional picture, a plastic one may be used, and as the sheet-like base 1 to be cut, one made of thick paper may be used.

As shown in FIG. 3, the embroidered picture obtained from the sheet for embroidered picture according to the present invention has a three-dimension with the sheet pieces 4 projecting on the fore side, and has an excellent designability with embroidery threads 3 of different colors arranged at the respective parts of the pictures or patterns shown in FIG. 2. In the embroidered picture shown in FIG. 2, the laminated sheet piece 4 in square shape has arranged embroidery thread 3 along each edge thereof, and this embroidery thread 3 is fixed with the sheet-like base 1 at each of the the perforation in the sheet piece 4.

Thus, the present invention consists in enabling in drawing a picture or pattern in the desired shape easily by utilizing the perforations 2 formed in the sheet-like base 1 in matrix form, being particularly suited for drawing a geometric pattern.

Further, a picture or pattern may be provided by e.g. printing on the surface of the sheet-like base 1 constituting the sheet for embroidered picture according to the present invention and utilizing it as a background for the picture or pattern drawn by means of embroidery thread, this enabling making an embroidered picture excellent in designability.

The embroidered picture made by using the sheet for embroidered picture according to the present invention may be used as an interior decoration with a frame, may be also used as a book's cover or the like.

Thus, the sheet for embroidered picture according to the present invention is particularly suited for drawing a picture or pattern by using an embroidery thread and enjoying embroidery, even by children. Moreover, by laminating sheet pieces in the desired shape and by fixing the same with embroidery threads on the surface for embroidered picture, it is possible to make an embroidered picture excellent in three-dimension as well as designability by fixing the sheet pieces in the desired shape on the surface of the sheet for embroidered picture, and if the sheet-like base is made of paper such as synthetic paper or thick paper, it is convenient for sheet pieces can be easily cut with a pair of scissors or the like.

It will be apparent from the foregoing that, while the present invention has been described in detail and illustrated, these are only particular illustrations and examples, and the present invention is not limited to these. The spirit and scope of the present invention is limited only by the appended claims.

What is claimed is:

1. A method of making an embroidered three dimensional picture, comprising the steps of:

providing at least one sheet for the embroidered picture, each of said at least one sheet being capable of being embroidered with an embroidery thread, said at least one sheet having perforations which have a 0.4–1.5 mm inside hole diameter and which are formed over at least a part of each said at least one sheet in matrix form, at least one of said at least one sheet being made of a material which can easily be cut;

providing at least one piece of thread which is capable of being passed through said perforations;

cutting at least one of said at least one sheet which is made of a material which can easily be cut to form at least one smaller sheet piece therefrom;

placing at least one of the at least one smaller sheet piece over a base sheet of said at least one sheet;

embroidering the thread through perforations both in said at least one of the at least one smaller sheet piece placed over the base sheet and in said base sheet.

2. The method of making an embroidered three dimensional picture according to claim 1, wherein said material is paper.

3. The method of making an embroidered three dimensional picture according to claim 2, wherein said material is synthetic paper.

4. The method of making an embroidered three dimensional picture according to claim 3, further including the step of forming a picture or pattern on a surface of said base sheet.

5. The method of making an embroidered three dimensional picture according to claim 3, wherein the thickness of said synthetic paper is approximately 0.4 mm.

6. The method of making an embroidered three dimensional picture according to claim 2, wherein said material is thick paper.

7. The method of making an embroidered three dimensional picture according to claim 6, further including the step of forming a picture or pattern on a surface of said base sheet.

8. The method of making an embroidered three dimensional picture according to claim 6, wherein the thickness of said thick paper is approximately 0.8 mm.

9. The method of making an embroidered three dimensional picture according to claim 2, further including the step of forming a picture or pattern on a surface of said base sheet.

10. The method of making an embroidered three dimensional picture according to claim 1, further including the step of forming a picture or pattern on a surface of said base sheet.

11. The method of making an embroidered three dimensional picture according to claim 1, wherein said inside hole diameter is approximately 0.8 mm.

12. The method of making an embroidered three dimensional picture according to claim 11, wherein said thread is selected from the group consisting of 2-ply thread or 3-ply thread.

13. The method of making an embroidered three dimensional picture according to claim 1, wherein the pitch between adjacent perforations in said matrix is 1.3–2.0 mm.

14. The method of making an embroidered three dimensional picture according to claim 1, wherein the pitch between adjacent perforations in said matrix is approximately 1.5 mm.

15. An embroidered three dimensional picture, comprising:

at least one sheet having a matrix of perforations which have a 0.4–1.5 mm inside hole diameter, at least one of said at least one sheet being made of a material which can be cut easily;

at least one smaller sheet piece which is cut from at least one of said at least one sheet which is made of a material which can be cut easily;

said at least one smaller sheet piece being located on top of a base sheet of said at least one sheet;

at least one piece of thread embroidered through the perforations in both said at least one of the at least one smaller sheet piece placed over the base sheet and said base sheet.

16. The embroidered three dimensional picture according to claim 15, wherein said material is paper.

17. The embroidered three dimensional picture according to claim 16, wherein said material is synthetic paper.

18. The embroidered three dimensional picture according to claim 16, wherein said material is thick paper.

19. The embroidered three dimensional picture according to claim 15, wherein said inside hole diameter is approximately 0.8 mm and the pitch between adjacent perforations is 1.5 mm.

20. The embroidered three dimensional picture according to claim 19, wherein said thread is selected from the group consisting of 2-ply thread or 3-ply thread.

* * * * *